US009640318B2

(12) United States Patent
Rosenfeld et al.

(10) Patent No.: US 9,640,318 B2
(45) Date of Patent: May 2, 2017

(54) NON-UNIFORM SPACING IN WIRELESS RESONATOR COIL

(71) Applicant: Intel Corporation, Santa Clara, CA (US)

(72) Inventors: Jonathan Rosenfeld, Portland, OR (US); Sreenivas Kasturi, Hillsboro, OR (US); Songnan Yang, San Jose, CA (US); Essam Elkhouly, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/318,304

(22) Filed: Jun. 27, 2014

(65) Prior Publication Data

US 2015/0162128 A1 Jun. 11, 2015

Related U.S. Application Data

(60) Provisional application No. 61/981,585, filed on Apr. 18, 2014, provisional application No. 61/913,275, filed on Dec. 7, 2013.

(51) Int. Cl.

| | |
|---|---|
| ***H01F 5/00*** | (2006.01) |
| ***H01F 38/14*** | (2006.01) |
| ***H01F 41/04*** | (2006.01) |
| ***H01F 27/28*** | (2006.01) |
| ***H01F 27/00*** | (2006.01) |

(52) U.S. Cl.

CPC ..... *H01F 38/14* (2013.01); *H01F 5/00* (2013.01); *H01F 27/006* (2013.01); *H01F 27/2804* (2013.01); *H01F 41/041* (2013.01); *Y10T 29/49071* (2015.01)

(58) Field of Classification Search

CPC ..... H01F 5/00; H01F 27/00–27/30
USPC ..... 336/65, 200, 232
See application file for complete search history.

(56) References Cited

U.S. PATENT DOCUMENTS

| | | | | | |
|---|---|---|---|---|---|
| 3,056,923 | A * | 10/1962 | Parker | H02K 3/26 | 324/150 |
| 5,038,104 | A * | 8/1991 | Wikswo, Jr. | G01R 33/0358 | 324/248 |
| 5,134,265 | A * | 7/1992 | Dickens | H05B 6/1254 | 219/621 |
| 5,227,597 | A * | 7/1993 | Dickens | A47J 37/0676 | 219/621 |
| 6,714,112 | B2 * | 3/2004 | Beng | H01F 17/0006 | 336/200 |
| 7,248,480 | B2 * | 7/2007 | Chiba | H01L 27/0641 | 257/E21.022 |
| 7,705,704 | B2 * | 4/2010 | Lee | H01F 17/0006 | 336/147 |

(Continued)

FOREIGN PATENT DOCUMENTS

| | | | |
|---|---|---|---|
| CN | 102738908 | A | 10/2012 |
| CN | 103534772 | A | 1/2014 |
| WO | 2009155000 | A2 | 12/2009 |

*Primary Examiner* — Tuyen Nguyen
(74) *Attorney, Agent, or Firm* — International IP Law Group, P.L.L.C.

(57) ABSTRACT

Techniques of forming a transmitter coil are described herein. The techniques may include forming turns of the transmitter coil, wherein a non-uniform spacing between the turns of the transmitter coil is to reduce a magnetic field variation associated with the transmitter coil.

8 Claims, 11 Drawing Sheets

100

(56) References Cited

U.S. PATENT DOCUMENTS

| | | | | |
|---|---|---|---|---|
| 9,171,663 | B2 * | 10/2015 | Barry | H01F 27/2804 |
| 9,177,709 | B2 * | 11/2015 | Parthasarathy | H01F 17/0013 |
| 2005/0275629 | A1 * | 12/2005 | Chin | G06F 3/0395 345/163 |
| 2008/0278112 | A1 | 11/2008 | Hui et al. | |
| 2012/0146580 | A1 | 6/2012 | Kitamura | |
| 2015/0303733 | A1 * | 10/2015 | Yang | H01F 27/2823 320/108 |

* cited by examiner

100

200A

200B

300

500C

500B

500A

600

700

800

900

NON-UNIFORM SPACING IN WIRELESS RESONATOR COIL

CROSS REFERENCE TO RELATED APPLICATIONS

The present application claims priority to U.S. Provisional Patent Application No. 61/913,275, filed Dec. 7, 2013, and U.S. Provisional Patent Application No. 61/981,585, filed Apr. 18, 2014, which are both incorporated herein by reference.

TECHNICAL FIELD

This disclosure relates generally to techniques for wireless charging. Specifically, this disclosure relates to a high uniformity wireless charging resonator.

BACKGROUND ART

Wireless power systems include a radio frequency source in the form of a power amplifier. The power amplifier may drive the system and may be modeled as an ideal constant current source. An important subsystem for any wireless power charging system may include a transmitter (Tx) and receiver (Rx) coil pair. In some aspects, these coils are referred to as resonators. The resonators may exhibit certain performance characteristics. Further, on the receiver side, a diode bridge may be used to rectify the input radio frequency signal into a direct current signal.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE ASPECTS

Figure 1:
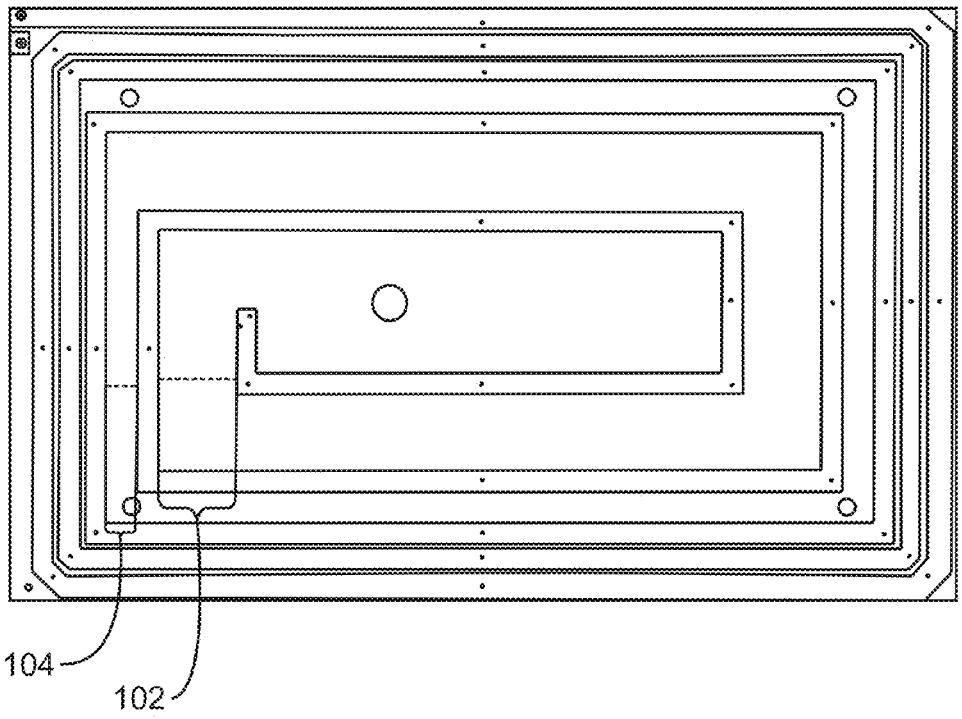
FIG. 1 illustrates a low-loss Tx coil.

The present disclosure relates generally to techniques for high resonator uniformity in wireless charging systems.

There are several important factors implicated in a resonator coil design such as coil to coil efficiency, ease of manufacturability, coil tolerances, and cost. One of the most important factors may include a Tx coil that is configured to produce minimum magnetic field variation, i.e., maximum field uniformity. Maximum field uniformity may be useful when a chargeable device with an Rx coil is placed on top of the Tx resonator. Since the dominant magnetic field component in such a coil is along a direction "z" extending perpendicular to the plane of coil, the uniformity is a factor in an $H_z$ component of the magnetic field. The $H_z$ component is the magnetic field in the z direction. This field component is impacted by the design of the coil, such as the number and distribution of the coil turns, the distance between the Tx coil to the Rx coil, and the charging device physical composition (i.e., copper steel, plastic, etc.).

Field uniformity may be useful for a robust operation of a wireless power system due to several reasons. The mutual inductance between the Tx and Rx resonators is related to the magnetic field as indicated by Equation 1.

$$M=(\mu H_z/I_{Tx})\times(N_{Rx}A_{rx}) \quad \text{Eq. 1}$$

In Equation 1, $H_z$ is the magnetic field in the z direction generated by the input current $I_{Tx}$ in the Tx coil. The constant $\mu$ is the magnetic permeability, and the "$N_{Rx}$" variable indicates the number of turns in a receiving coil (Rx coil). The "$A_{rx}$" variable indicates the surface area of the Rx coil. In some aspects, the $A_{rx}$ refers to a surface area of a charging pad of the Rx coil. The relationship between the input current $I_{Tx}$ and the output voltage ($V_{Rx}$) on the receiver coil is indicated by Equation 2.

$$V_{Rx}=\omega M I_{Tx}=Z_{21}I_{Tx} \quad \text{Eq. 2}$$

In Equation 2, $\omega$ is radian frequency (2 times Pi times the frequency in hertz). The variable $Z_{21}$ is a "network parameter." In aspects, network parameter may describe a link between two components in a network. The variable $Z_{21}$ is a z network parameter that links port 1 (transmitter) and port 2 (receiver) in the network of the transmitter and the receiver.

As evident from Equation 1 and Equation 2, large variations of the magnetic field $H_z$ will result in large variations of the voltage produced on the receiver side. This voltage variation can exceed the breakdown voltage of the diodes. A wireless power receiving unit (PRU) may include diodes configured to pass voltage in one direction. The diodes may also be configured to pass voltage in an opposite direction. However, when voltage is passed through the diodes in the opposite direction a voltage limit may be imposed beyond which the diodes begin to break down. Further, a voltage variation may, in some scenarios, exceed the voltage range allowed by the voltage regulator following the diode bridge.

An additional issue with a large mutual inductance variation is the load presented to the power amplifier (PA). In this scenario, the Tx coil and the Rx coil are components within a power transfer system. A variation in mutual inductance occurs between the two coils, and the variation has implications on both sides. On the receive side, the implication is that the voltage variation will be large, as shown by Equation 2. On the transmit side, the impedance of the power amplifier will be large, as the impedance is also a function of mutual inductance as illustrated in Equation 3.

$$Z_{TxIn}=R_{Tx}+(\omega M)^2/(R_{Rx}+R_{load}) \quad \text{Eq. 3}$$

In Equation 3, $Z_{TxIn}$ is the load presented to the power amplifier (PA), $R_{Tx}$ is loss resistance of the transmitter, $R_{Rx}$ is a loss resistance of the receiver, while $R_{load}$ is the load of the receiver.

Most PA designs are limited in the load variations they can tolerate while providing power at high efficiency. From Equation 3, it is evident that large field variations will result in large input impedance driven by the PA proportional to the square of the mutual inductance. Further, when moving the charging device from high to low coupling region, the system may not be able to provide enough power for short time periods resulting in a temporary loss of charging power.

A conventional coil design may include numerous turns with similar spacing between the turns. However, numerous turns with similar spacing produces highly non-uniform field distribution since destructive fields and constructive field generated by each turn will aggregate up in a highly non-uniform manner, resulting in large field variations.

FIG. 1 illustrates a low-loss Tx coil. In order to mitigate the effects caused by large magnetic field variations, an optimized Tx coil design may include a Tx coil having non-uniform spacing between the turns of the coil, as indicated by the relative lengths between brackets 102 and 104. The non-uniform spacing may result a relatively more uniform magnetic field as illustrated below in FIG. 2. The proposed design reduces the variations while enabling other components of the system to operate in a robust manner.

In some aspects, the Tx coil 100 may be formed in a printed circuit board (PCB) as illustrated in FIG. 1. The use of PCB to implement the coil may permit a very tight control on process variations in manufacturing. Additionally, since PCB technology is a very mature technology it is suitable for high volume manufacturability as well as ease of integration with the circuit board. Another advantage is a relatively short "z" height that is possible to achieve with this technology in relation to a coil that is not integrated into the PCB. In this design, the total thickness of the PCB coil board may be about 0.8 millimeters as compared to a traditional coil of about 4.2 millimeters.

Additionally, an efficiency of power transfer from the Tx coil to a Rx coil is increased relative to traditional designs that do not include the PCB integrated coil. This efficiency is partially achieved due to the resistance of the Tx coil when integrated within the PCB. However, in some cases PCB coils exhibit high resistance to dielectric losses and small trace thickness. To combat this high resistance to dielectric losses and small trace thickness, the techniques described herein include a coil constructed by connecting three identical PCB metal layers in parallel using vias. Using this technique permits the design of a low loss coil.

Another characteristic of this design is a reduction magnetic field variations with respect to the Rx coil location. Reduced magnetic field variations are critical to achieve the required performance of the wireless power transfer system.

Figure 2A:
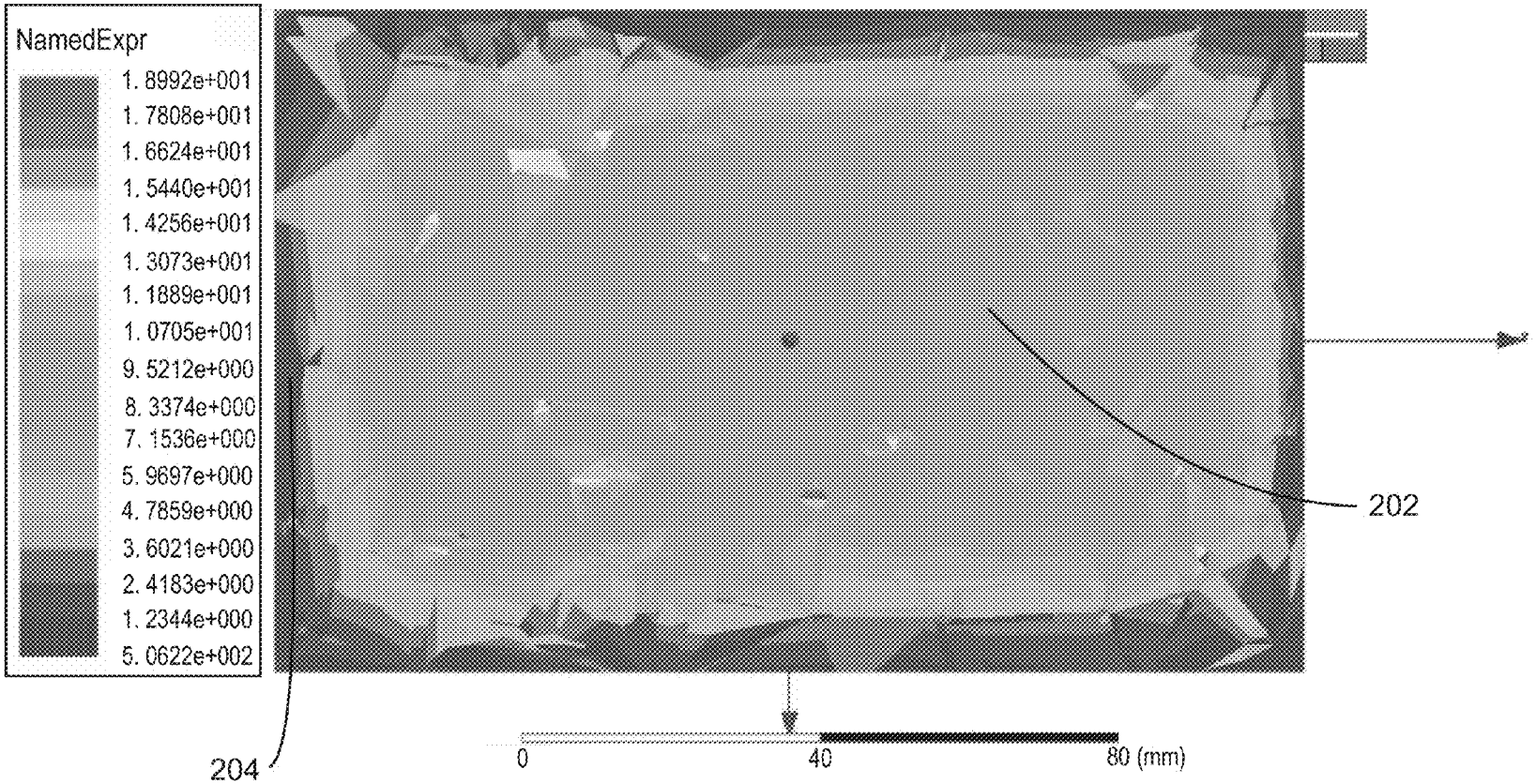
FIG. 2A is a distribution of a magnetic field resulting from a non-uniform spacing between the turns of the coil Tx coil.
Figure 2B:
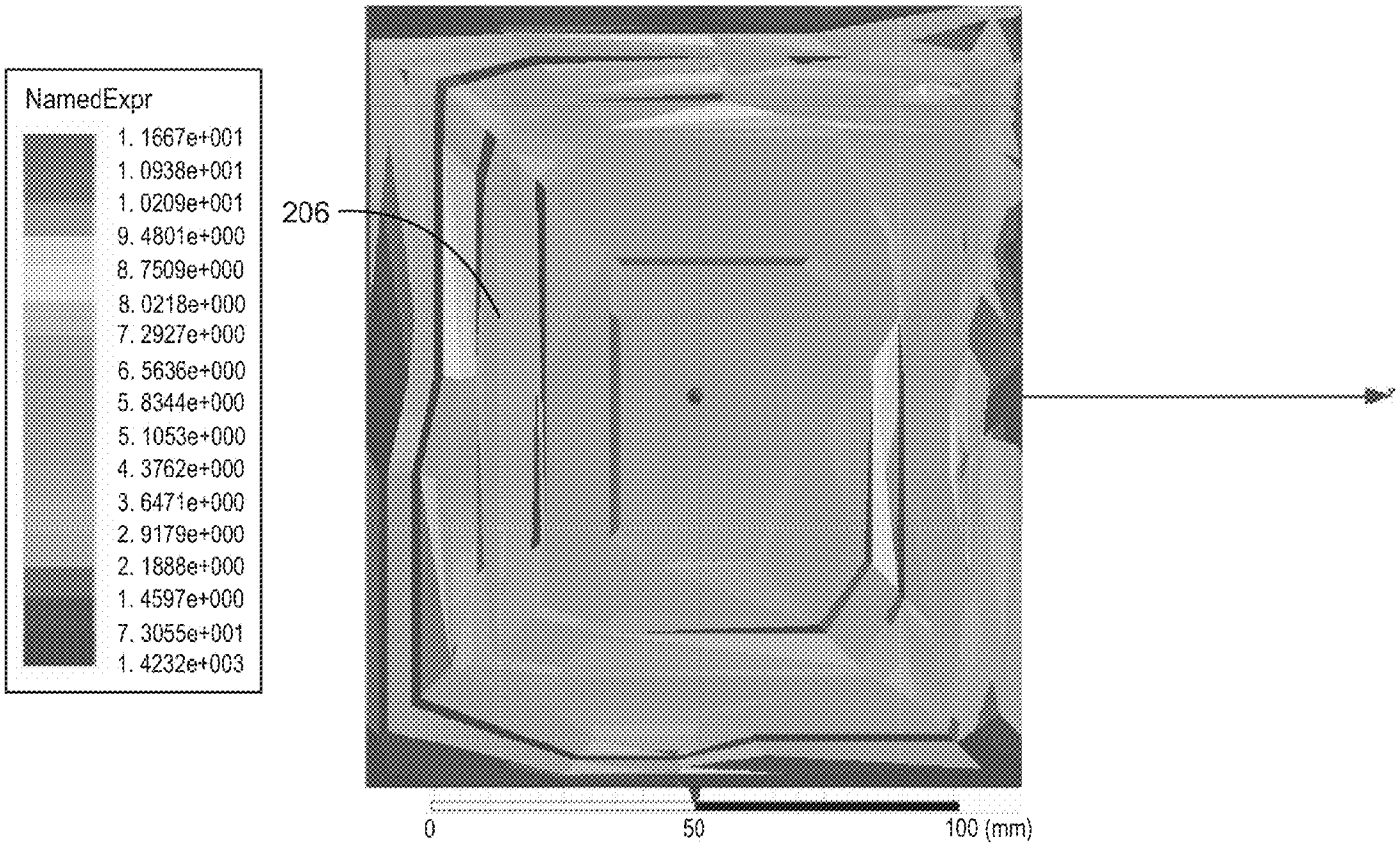
FIG. 2B is a distribution of a magnetic field resulting from a Tx coil having uniform spacing.

FIG. 2A is a distribution of a magnetic field resulting from a non-uniform spacing between the turns of the coil Tx coil, while FIG. 2B is a distribution of a magnetic field resulting from a Tx coil having uniform spacing. At 11 millimeters distance from the coil, the distribution of the z component of the magnetic field is shown in FIG. 2A across the coil area generally indicated by the arrow 202. As illustrated in FIG. 2A, the magnetic field within the coil area 202 is uniform with a magnitude of about 10 A/m when driven by a 0.5 amp current source. As expected, the field magnitude falls rapidly towards the edges of the coil, such the area indicated at 204. In comparison, Tx coil having uniform spacing generates a non-uniform distribution in the magnetic field within the coil area generally indicated by the arrow 206.

Figure 3:
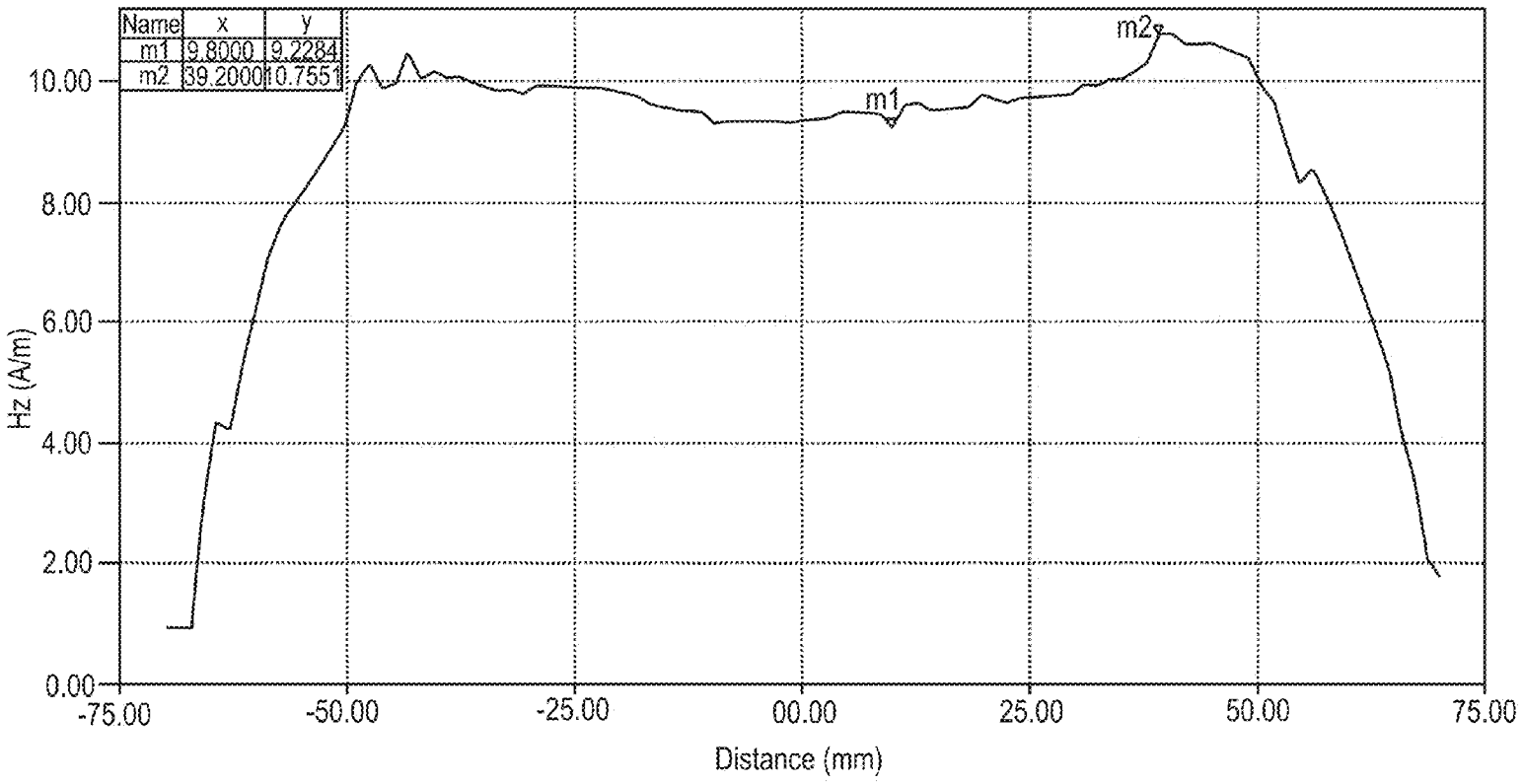
FIG. 3 is a graph illustrating the magnetic field as a measure of distance from the center of the low-loss coil.

FIG. 3 is a graph illustrating the magnetic field as a measure of distance from the center of the low-loss coil. The distribution in the graph 300 is of the z component of the magnetic field log line. As illustrated in FIG. 3, to quantify the field variations in a more accurate way, the filed is plotted along the y axis across the coil (−70 millimeters to +70 millimeters). Along this line the field varies between 9.2 and 10.7 A/m (+/−8%). To compare the performance of the uniform design Tx coil, consider a traditional coil.

Figure 4:
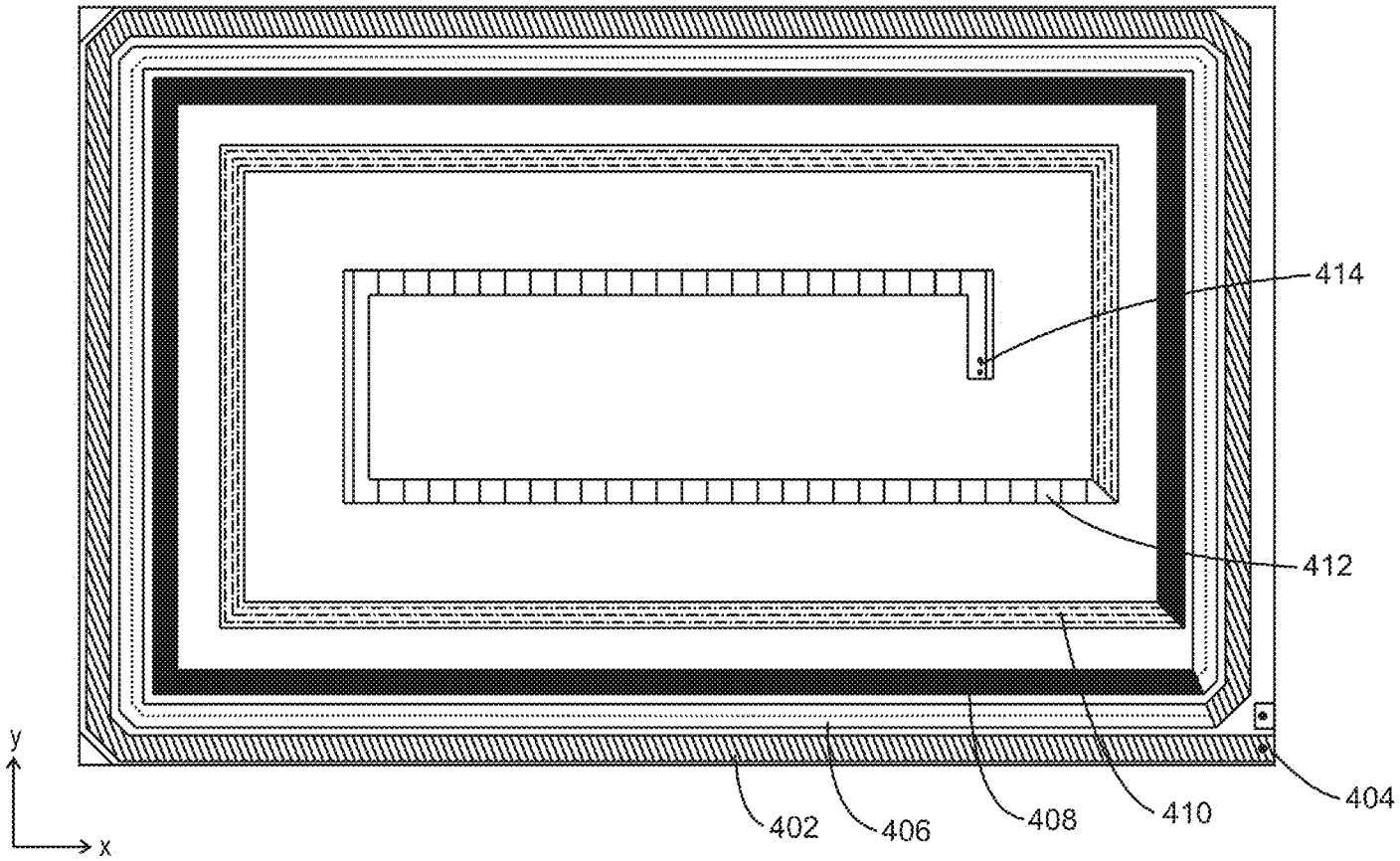
FIG. 4 illustrates a top view of a coil having non-uniform spacing between turns of the coil.

FIG. 4 illustrates a top view of a coil having non-uniform spacing between turns of the coil. In reference to FIG. 4, a distance in the x direction may be referred to as a "length" while a distance in the y direction may be referred to as a "width." The example Tx coil 400 may be implemented as a trace on a PCB board having a length, in the x direction, of about 143.5 millimeters long and a width, in the y direction, of about 91 millimeters.

A "turn" of the Tx coil 400 may be referred to herein as a circumferential portion of the Tx coil. A first turn, indicated by the shaded area 402 may have a length of about 140 millimeters and a width of about 90 millimeters. The first turn may be coupled to a via 404, and a second turn, indicated by the shaded area 406.

The second turn 406, may have a length of about 132 millimeters and a width of about 82 millimeters. The second turn 404 may be coupled to a third turn, indicated by the shaded area 408, having a length of about 124 millimeters and a width of about 74 millimeters.

The third turn 406 may be coupled to a fourth turn, indicated by the shaded area 410, having a length of about 108 millimeters and a width of about 58 millimeters. The fourth turn 410 may be coupled to a fifth turn, indicated by the shaded area 412.

The fifth turn 412 may have a length of about 78 millimeters and a width of about 28 millimeters. The fifth turn 412 may be coupled to a via 414. The via 414 may be appropriately coupled to the via 404 to complete a circuit for the Tx coil 400.

Figure 5C:
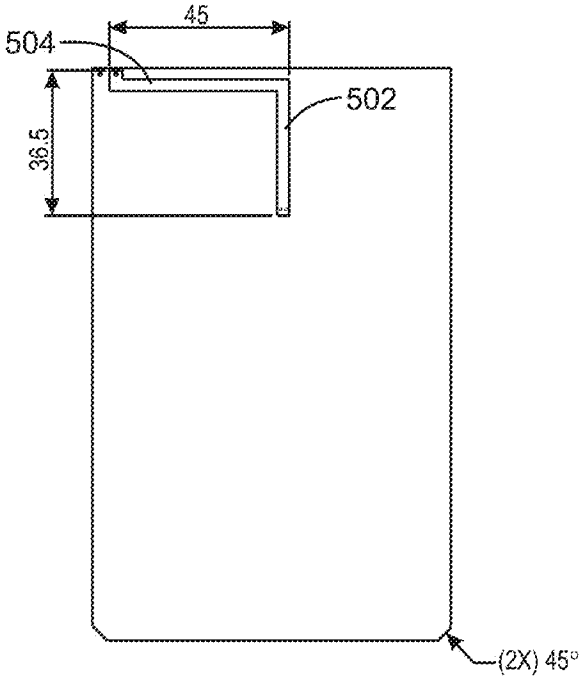
FIG. 5C is a bottom view of the coil having non-uniform spacing between the turns of the coil.
Figure 5B:
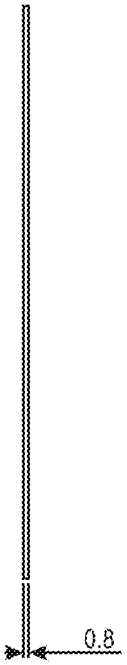
FIG. 5B is a side view of the coil having non-uniform spacing between the turns of the coil.
Figure 5A:
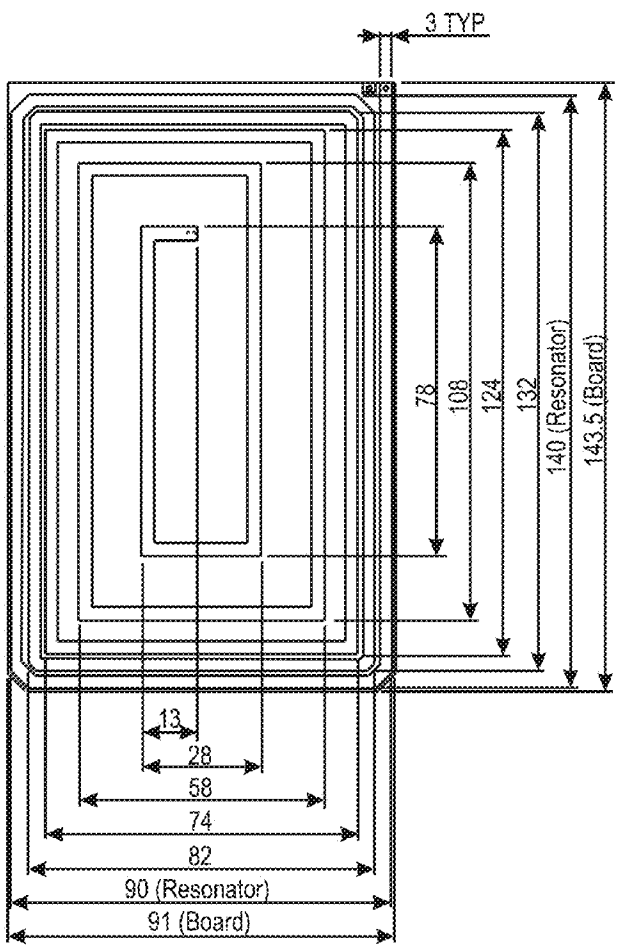
FIG. 5A illustrates a top view of a coil having non-uniform spacing between turns of the coil.

FIG. 5A illustrates a top view of a coil having non-uniform spacing between turns of the coil. In the aspects described herein, a coil is formed having a spacing between turns of the coil based on a ratio. The ratio may be based on the measurements illustrated in FIG. 4. The spacing between the terms may be non-uniform and may result in increased magnetic field uniformity. To generate low field variations the Tx coil design has a non-uniform spacing between each coil turn. The destructive and constructive fields generated by each turn add up in an optimum form, resulting in small field variations.

FIG. 5B is a side view of the coil having non-uniform spacing between the turns of the coil. As illustrated in FIG. 5B, the thickness of the coil may be 0.8 millimeters. As discussed above, a thickness of 0.8 millimeters may be beneficial in reducing a "z" height of the coil, and is enabled by implementing the Tx coil in a PCB.

FIG. 5C is a bottom view of the coil having non-uniform spacing between the turns of the coil. The bottom view of FIG. 5C illustrates a coupling of the coil to create a loop. In aspects, the transmitter coil is formed in a printed circuit board (PCB). The transmitter coil formed in the PCB includes more than one layer of transmitter coil, and wherein each layer is communicatively coupled at a via between the layers. For example on a bottom layer, the Tx coil may have a first trace 502 electrically coupled to the inner most turn, such as the fifth turn 414 discussed above in reference to FIG. 4. The first trace 502 may be approximately 36.5 millimeters long. A second trace 504 may be formed on the bottom layer electrically coupling the first trace to a via electrically coupled to an outer most turn, such as the first turn 402 discussed above in reference to FIG. 4. The second trace may be approximately 45 millimeters.

Figure 6:
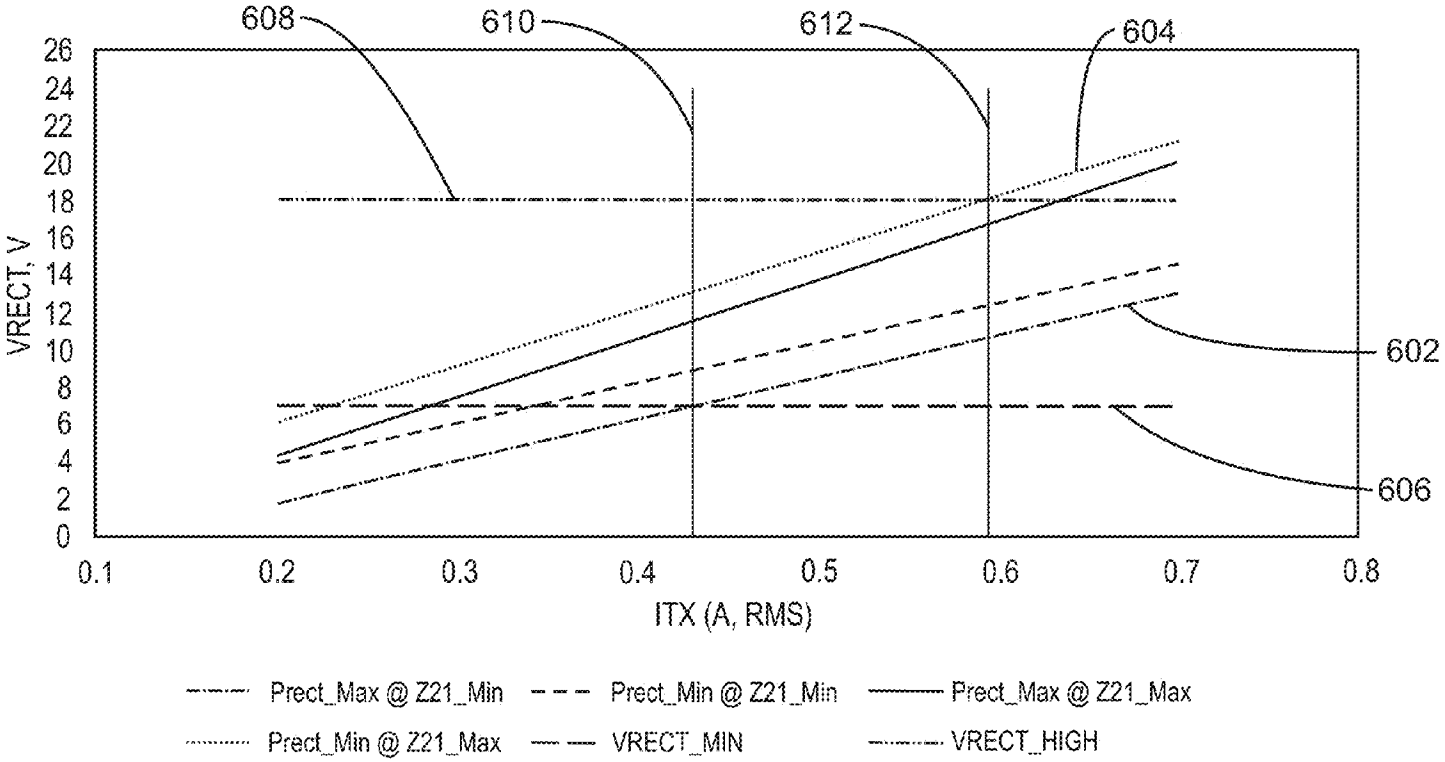
FIG. 6 is a graph illustrating rectifier voltage versus coil current

FIG. 6 is a graph illustrating rectifier voltage versus coil current. As illustrated in FIG. 6, an output DC voltage on the receiver side ($V_{rect}$) is plotted as a function of the root means square (RMS) voltage flowing through the Tx coil. Since the output voltage on the receiver side is limited by the input voltage of the voltage regulator (shown as Rload in FIG. 1), it is important to verify two possible extreme cases, i.e., maximum power delivered at minimum $Z_{21}$, as indicated by the reference number 602, and minimum power delivered at maximum $Z_{21}$, as indicated by the reference number 604 in FIG. 6. During the maximum power delivered at minimum $Z_{21}$ operating point, the PA will need to provide maximum current. During the minimum power delivered at maximum $Z_{21}$ operating point, the PA will need to provide minimum current. If during either maximum or minimum operating points the voltage provided to the voltage regulator is within the permitted limits, indicated by the lower dashed line 606 and the upper dashed lined 608, the system is considered to be stable.

In the case of large field variations, i.e., large $Z_{21}$ variations, a very limited range of $I_{Tx}$, indicated as the area between by the vertical lines 610 and 612, provided by the PA will satisfy the voltage range permitted by the voltage regulator. This will result in a non-stable system that cannot be optimized by the feedback loop of the system.

Figure 7:
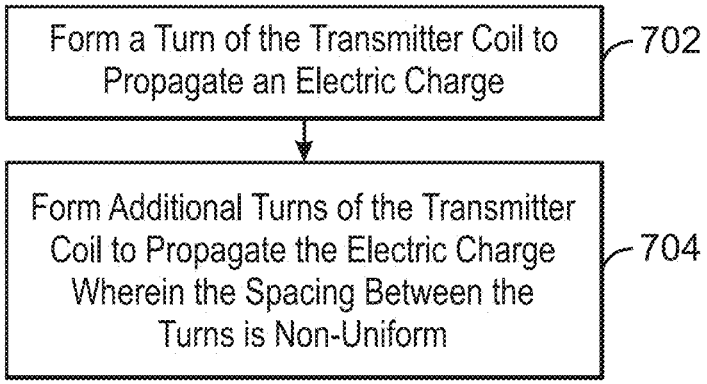
FIG. 7 illustrates a method of forming a transmitter coil.

FIG. 7 illustrates a method of forming a transmitter coil. The method comprises forming a turn of the transmitter coil to propagate an electric charge at block 902. At block 904, additional turns are formed to propagate the electric charge wherein the spacing between the turns is non-uniform.

In aspects, the transmitter coil is formed in a printed circuit board (PCB). The transmitter coil formed in the PCB includes more than one layer of transmitter coil, and wherein each layer is communicatively coupled at a via between the layers. For example on a bottom layer, the method 700 may include forming a first trace electrically coupled to the inner most turn, such as the fifth turn 414 discussed above in reference to FIG. 4. The first trace may be approximately 36.5 millimeters long. A second trace may be formed on the bottom layer electrically coupling the first trace to a via electrically coupled to an outer most turn, such as the first turn 402 discussed above in reference to FIG. 4.

The turns of the transmitter coil are non-uniform based on predefined spacings between the turns. In some aspects, the turns of the transmitter coil are non-uniform based on predefined spacings between the turns, wherein the spacing between the turns indicates a ratio of the spacing between the turns. For example, the ratio may be indicated by the spacing between turns as illustrated in FIG. 6A.

In some aspects, a systematic synthesis procedure is used to optimize the magnetic field distribution. Specifically, the systematic synthesis procedure is used to determine a spacing of coil turns and coil portions coupled by the turns of the transmitter coil.

Figure 8:
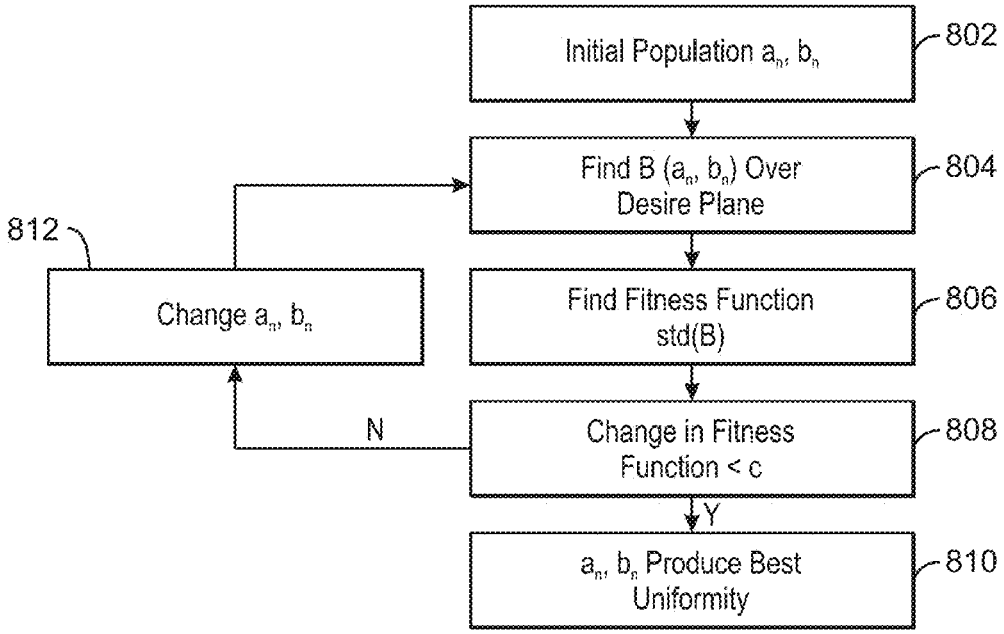
FIG. 8 is a block diagram illustrating a method for determining optimized non-uniform spacing in a transmitter coil.

FIG. 8 is a block diagram illustrating a method for determining optimized non-uniform spacing in a transmitter coil. At block 802, initial measurements of the coil are determined. Variables "a" and "b" represent the overall length and width of the transmitter coil, respectively. The length and width of the transmitter coil may be based on the outermost turns of the transmitter coil having a measurement of $a_n$ length and width of $b_n$. The lengths and widths of increasingly smaller turns of the transmitter coil may be referred to as $a_{n-1}$ and $b_{n-1}$, respectively. At block 804, the magnetic field B, is found over a desired plane, or over a given transmitter coil having a length $a_n$ and a width $b_n$.

Although not illustrated in FIG. 8, a desired variance in magnetic field may be determined. Variance of magnetic field may be dependent on a distance "z" from the transmitter coil, and within 70% of the entire coil area (a multiplied by b).

In some aspects, the variance in magnetic field may be a maximum allowed threshold associated with a standard wireless charging committee, such as the Alliance for Wireless Power Transfer System Baseline System Specification, version 1.1.1. from Aug. 14, 2013 (A4WP specification). The magnetic field may be determined by Equation 4:

$$B(x_o, y_o, z_o) = \frac{\mu_0}{4\pi}\int_c \frac{I dl \times \hat{r}}{|r|^2}. \quad \text{Eq. 4}$$

In some scenarios, Eq. 4 may be referred to as the Biot-Savart law. The Biot-Savart law is used for computing the resultant magnetic field "B" at position "r" generated by a constant current "I." In Eq. 4, "$\mu_0$" may be a magnetic constant, while "$\hat{r}$" is the unit vector of "r." The integral unit "dl" is an infinitely small length of a coil portion. Equation 4 may be further applied to n arbitrary concentric rectangular current loops of the transmitter coil, yielding the total sum of the magnetic field at a certain vertical distance from the transmitter coil. By varying the geometric lengths of rectangular loops comprising a resonating transmitter coil structure, and calculating the resulting magnetic field, an optimization function with a desired magnetic field variance as its objective is described herein.

For computer analysis, Eq. 4 may be converted to a summation function, as illustrated in Equation 5:

$$B(x_o, y_o, z_o) = \frac{\mu_0}{4\pi}\sum_n \frac{I\Delta l \times \hat{r}_n}{|r_n|^2}. \quad \text{Eq. 5}$$

In Eq. 5, $r_n$ is a vector that points from the center of a Δl section to a magnetic field observation point. In some cases, the distance z between the center of the Δl section to the observation point may be 11 millimeters above the surface of the transmitter coil.

Returning to FIG. 8, a variation in magnetic field is determined for a coil having a given area, at indicated at block 806. In some scenarios, the variation in the magnetic field may be constrained by a fitness function, described in more detail below. At block 808, if the change in the magnetic field in view of the constraints of the fitness function is less than a threshold, then lengths and widths, $a_n$ $b_n$, $a_{n-1}$ $b_{n-1}$, and so on, are determined to be optimized, as indicated at block 810. However, if at block 808, the change in the magnetic field in view of the constraints of the fitness function are not less than the threshold, then lengths and widths are adjusted at block 812.

As discussed above, the variation in the magnetic field may be constrained by a fitness function. In this particular Tx coil design, the structure that was investigated is a rectangular spiral coil having about 9 centimeter width, an about 14 centimeter length, and 5 turns, as discussed generally above in the aspect described in FIG. 4. The Tx coil is constructed from 5 concentric rectangulars with $a_n$ and $b_n$ widths and lengths, respectively. $a_n$ and $b_n$ are the optimization variables. In the case of five turns eight variables are created.

In order to maintain minimum distance between turns to permit 3 millimeter trace and 1 millimeter space widths, a 4 millimeter minimum distance may be used. Additionally, the width and length of each turn is required to be greater than the next smaller turn, i.e., $a_n > a_{n-1}$ and $b_n > b_{n-1}$.

The optimization problem definition, where 2 is the unit vector in z direction, is defined by the fitness function illustrated in set of Equations 6-8.

$$\arg_{a_n,b_n}\min(\mathrm{std}(B(a_n,b_n)\cdot\hat{z})),\ \text{subject to: } 0<a_n<14\text{ cm},\ 0<b_n<9\text{ cm} \quad \text{Eq. 6}$$

$$z_o=11\text{ mm},\ 0<x_o<10\text{ cm},\ 0<y_o<6.3\text{ cm} \quad \text{Eq. 7}$$

$$\text{Linear constraints: } a_n>a_{n-1}+5\text{ mm},\ b_n>b_{n-1}+5\text{ mm} \quad \text{Eq. 8}$$

Figure 10:
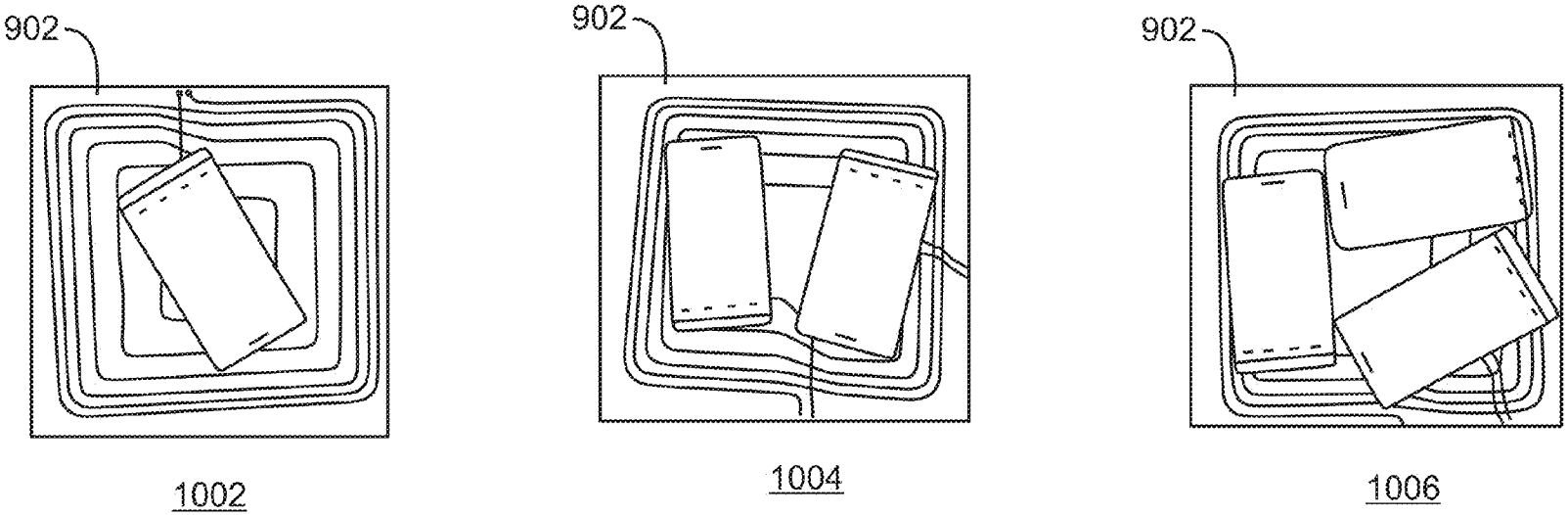
FIG. 10 illustrates a high power coil being used to charge one-to-many devices.

The constraints of Eqs. 6-8 may be utilized in a genetic algorithm to solve the optimization problem, as illustrated in FIG. 10. In aspects, a genetic algorithm may be is a search heuristic that mimics the process of natural selection.

The optimization process starts by an arbitrary setting $a_n$ and $b_n$. Eq. 5 is used to calculate the z component of the magnetic field across a surface at a required z height. The optimization is then performed on the fitness function of equations 6-8. The criteria for stopping the optimization is the amount of change of the aggregate magnetic field. When the change of the magnetic field is smaller than a certain threshold, the set values of $a_n$ and $b_n$ are considered the best found to create the lowest magnetic field variations.

Figure 9:
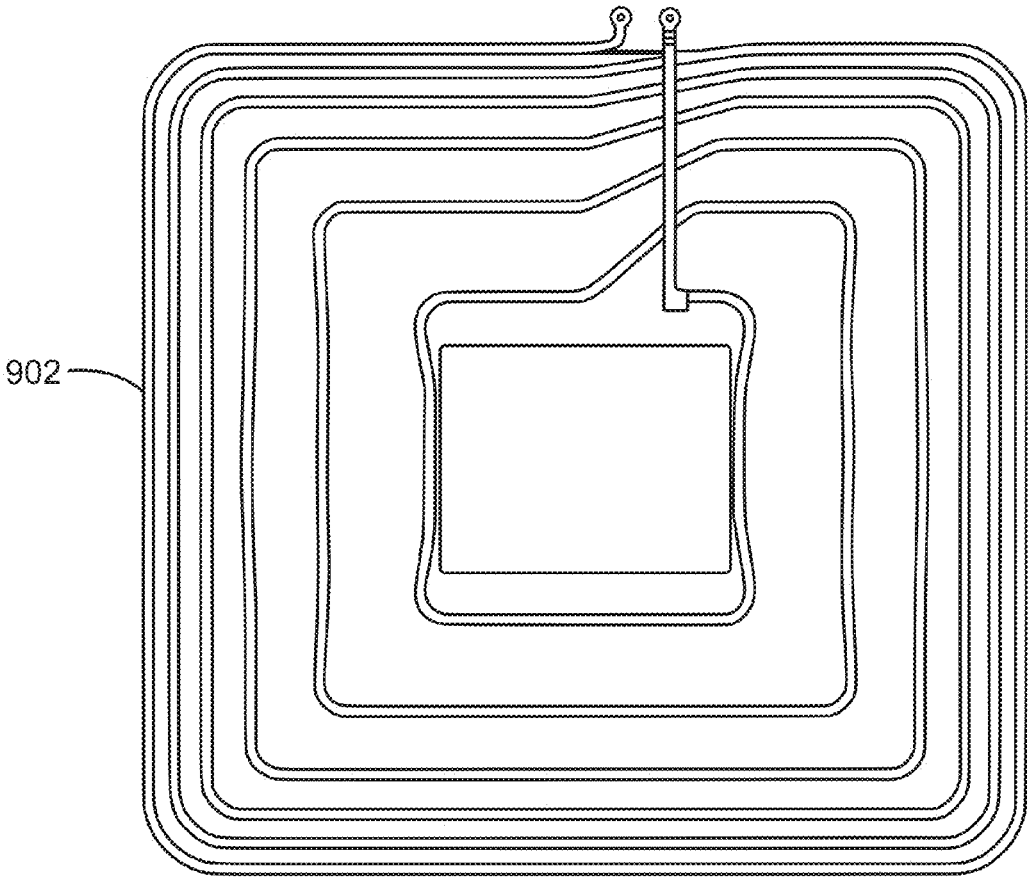
FIG. 9 illustrates an example transmitter coil having turns determined by the optimization process.

FIG. 9 illustrates an example transmitter coil having turns determined by the optimization process. As illustrated in FIG. 9, the turns have non-uniform spacing between the turns, as determined by the optimization process discussed above in reference to FIG. 8.

In aspects, the method 800 described above in reference to FIG. 8, may enable higher power transmitter coils to be produced. In some examples, a high power transmitter coil is one that can deliver 33 watts to an Rx coil, according to the A4WP specification. A high power transmitter coil 902, illustrated in FIG. 9, may be formed by a metal stamping technology, but can also be fabricated using PCB or wire technologies. The stamping technique permits fabrication of low z-height coils. In this case the coil thickness is 0.8 millimeters. Despite the larger dimension of the high power coil in FIG. 9, the optimization technique proposed in this disclosure generates a highly uniform magnetic field distribution.

FIG. 10 illustrates a high power coil being used to charge one-to-many devices. The high power coil 902 may be useful because the power emitted may be used by one or more devices, as indicated by 1002, 1004, or 1006.

Example 1 includes a transmitter coil to generate a magnetic field. The transmitter coil includes a turn to propagate an electric charge, and additional turns of the transmitter coil to propagate the charge. The spacing between the turns is non-uniform. The spacing between the turns may be determined via variables including a length and width of the transmitter coil, a number of turns of the transmitter coil, a minimum spacing between the turns, as well as a thickness of the coil, and a minimum magnetic field variation.

Example 2 includes method of forming a transmitter coil. The method includes forming a turn to propagate an electric charge, and forming additional turns of the transmitter coil to propagate the charge. The spacing between the turns is non-uniform. The spacing between the turns may be determined via variables including a length and width of the transmitter coil, a number of turns of the transmitter coil, a minimum spacing between the turns, as well as a thickness of the coil, and a minimum magnetic field variation.

Example 3 includes a method of determining optimized non-uniform spacing. The method includes identifying variables including a length and width of the transmitter coil, a number of turns of the transmitter coil, a minimum spacing between the turns, as well as a thickness of the coil, and a minimum magnetic field variation. The optimized spacing between turns of the transmitter coil being based on the identified variables.

Example 4 includes a transmitter coil to generate a magnetic field. The transmitter coil includes a means to propagate an electric charge and additional means to propagate the electric, wherein propagation from one coil means to another coil means generates an electric field. The spacing between the means is non-uniform.

Example 5 includes an apparatus to generate a magnetic field. The apparatus may include a turn to propagate an electric charge, and additional turns of the apparatus to propagate the charge. The spacing between the turns is non-uniform. The spacing between the turns may be determined via variables including a length and width of the apparatus, a number of turns of the apparatus, a minimum spacing between the turns, as well as a thickness of the apparatus, and a minimum magnetic field variation.

Example 6 includes a system to generate a magnetic field. The system includes a turn to propagate an electric charge, and additional turns of the system to propagate the charge. The spacing between the turns is non-uniform. The spacing between the turns may be determined via variables including a length and width of the system, a number of turns of the system, a minimum spacing between the turns, as well as a thickness of the system, and a minimum magnetic field variation.

In the description contained herein, numerous specific details are set forth, such as examples of specific types of processors and system configurations, specific hardware structures, specific architectural and micro architectural details, specific register configurations, specific instruction types, specific system components, specific measurements/heights, specific processor pipeline stages and operation etc. in order to provide a thorough understanding of the present invention. It will be apparent, however, to one skilled in the art that these specific details need not be employed to practice the present invention. In other instances, well known components or methods, such as specific and alternative processor architectures, specific logic circuits/code for described algorithms, specific firmware code, specific interconnect operation, specific logic configurations, specific manufacturing techniques and materials, specific compiler implementations, specific expression of algorithms in code, specific power down and gating techniques/logic and other specific operational details of computer system haven't been described in detail in order to avoid unnecessarily obscuring the present invention.

An aspect is an implementation or example. Reference in the specification to "an aspect," "one aspect," "some aspects," "various aspects," or "other aspects" means that a particular feature, structure, or characteristic described in connection with the aspects is included in at least some aspects, but not necessarily all aspects, of the present techniques. The various appearances of "an aspect," "one aspect," or "some aspects" are not necessarily all referring to the same aspects.

Not all components, features, structures, characteristics, etc. described and illustrated herein need be included in a particular aspect or aspects. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some aspects have been described in reference to particular implementations, other implementations are possible according to some aspects. Additionally, the arrangement and/or order of circuit elements or other features illustrated in the drawings and/or described herein need not be arranged in the particular way illustrated and described. Many other arrangements are possible according to some aspects.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more aspects. For instance, all optional features of the computing device described above may also be implemented with respect to either of the methods or the computer-readable medium described herein. Furthermore, although flow diagrams and/or state diagrams may have been used herein to describe aspects, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. A coil to generate a magnetic field, comprising:

a turn of the coil to propagate an electric charge; and at least one additional turn of the coil to propagate the electric charge, wherein the propagation of electric charge from one coil turn to another coil turn generates a magnetic field above the coil, and wherein the spacing between the coil turns is non-uniform and increases the uniformity of the magnetic field above the coil compared to a uniform spacing of the coil turns;

wherein the non-uniform spacing between the turns of the coil is based on variables, the variables comprising:

a predetermined minimum spacing between turns as well as a predetermined thickness of the coil; and a predetermined maximum magnetic field variance to be emitted by the coil.

2. The coil of claim 1, wherein the coil turns comprise:

a first coil turn having a length of about 140 millimeters and a width of about 90 millimeters; and a second coil turn coupled to the first coil turn, the second having a length of about 132 millimeters and a width of about 82 millimeters.

3. The coil of claim 2, wherein the coil turns comprise:

a third coil turn coupled to the second coil turn having a length of about 124 millimeters and a width of about 74 millimeters; and a fourth coil turn coupled to the third coil turn, the fourth turn having a length of about 108 millimeters and a width of about 58 millimeters.

4. The coil of claim 3, wherein the coil turns comprise:

a fifth coil turn coupled to the fourth coil turn, the fourth coil turn having a length of about 78 millimeters and a width of about 28 millimeters;

wherein the fifth coil turn is coupled to a via communicatively coupled to the first turn.

5. The coil of claim 1, wherein the transmitter coil is formed in a printed circuit board (PCB) about 143.5 millimeters long and about 91 millimeters wide.

6. The coil of claim 5, the PCB comprising more than one layer of coil, and wherein each layer is coupled at a via between the layers.

7. The coil of claim 6, wherein the coil is formed in a printed circuit board (PCB) having more than one layer, further comprising:

a plurality of traces of the transmitter coil at a bottom later of the PCB electrically coupled to at least one additional turn of the coil; the plurality of traces comprising:

a first trace having a length of about 36.5 millimeters; and a second trace having a length of about 45 millimeters.

8. The coil of claim 1, wherein the variables comprise:

a length and width of the coil; and a number of turns of the coil.

* * * * *